United States Patent [19]

Shigeta et al.

[11] Patent Number: 4,558,297

[45] Date of Patent: Dec. 10, 1985

[54] SATURABLE CORE CONSISTING OF A THIN STRIP OF AMORPHOUS MAGNETIC ALLOY AND A METHOD FOR MANUFACTURING THE SAME

[75] Inventors: Masao Shigeta, Urayasu; Teruhiko Ojima, Nagareyama, both of Japan

[73] Assignee: TDK Corporation, Tokyo, Japan

[21] Appl. No.: 538,886

[22] Filed: Oct. 4, 1983

[30] Foreign Application Priority Data

| | | | |
|---|---|---|---|
| Oct. 5, 1982 | [JP] | Japan | 57-174795 |
| Nov. 24, 1982 | [JP] | Japan | 57-206639 |
| Jul. 28, 1983 | [JP] | Japan | 58-136885 |

[51] Int. Cl.[4] ..... H01F 27/24

[52] U.S. Cl. ..... 336/213; 336/218; 336/219

[58] Field of Search ..... 336/213, 218, 219; 148/108, 121, 154

[56] References Cited

U.S. PATENT DOCUMENTS

| | | | |
|---|---|---|---|
| 4,116,728 | 9/1978 | Becker et al. | 336/213 X |
| 4,197,146 | 4/1980 | Frischmann | 148/31.55 X |
| 4,227,120 | 10/1980 | Luborsky | 336/218 X |
| 4,262,233 | 4/1981 | Becker et al. | 336/233 X |
| 4,355,221 | 10/1982 | Lin | 219/10.43 |
| 4,363,088 | 12/1982 | Yamamoto et al. | 363/59 |
| 4,410,392 | 10/1983 | Winter | 156/603 |

OTHER PUBLICATIONS

"High Current Linear Induction Accelerator for Electrons", N. C. Christofilos et al., The Review of Scientific Instruments, vol. 35, No. 7, Jul., 1964, pp. 886–890.

"Pulsed Power Switching Using Saturable Core Inductors", M. Stockton et al., J. Appl. Phys. 53 (3), Mar., 1982, pp. 2765–2767.

"Metallic Glasses for Magnetic Switches", Carl H. Smith, IEEE Conf. Record of 15th Power Modulator Symposium, Jun. 14–16, 1982, Baltimore, Md., pp. 22–27.

"Amorphous Metal Reactor Cores for Switching Applications", Carl H. Smith and Milton Rosen, Pro. 3rd Int'l. Power Conversions Conf., Munich, Sep., 1981, pp. 13–28.

"Magnetic Modulator for Low-Impedance Discharge Lasers", E. Y. Chu et al., IEEE, 1982, pp. 32–36.

"Magnetic Losses in Metallic Glasses Under Pulsed Excitation", C. H. Smith, IEEE Particle Accelerator Conf., Santa Fe, N. Mex., Mar., 1983.

"Development of Stripline Magnetic Modulators", W. C. Nunnally et al., IEEE, 1982, pp. 28–31.

"The Application of Magnetic Switches as Pulse Sources for Induction Linacs", D. Birx et al., IEEE Particle Accelerator Conf., Mar., 1983, pp. 1–6.

"Basic Principles Governing the Design of Magnetic Switches", D. L. Birx et al., L.L.L. UCRL-18831, Nov. 18, 1980, pp. 1–25.

*Primary Examiner*—Reinhard J. Eisenzopf

*Attorney, Agent, or Firm*—Armstrong, Nikaido, Marmelstein & Kubovcik

[57] ABSTRACT

The present invention relates to a saturable core which consists of a coiled thin strip of an amorphous magnetic alloy. The present invention provides a saturable core having a high ΔBs, a low power loss, a good saturation property, and low secular changes of the magnetic properties, due to determining the coiling direction of the saturable core so that it is the same as that of a coil heat treated.

13 Claims, 11 Drawing Figures

SATURABLE CORE CONSISTING OF A THIN STRIP OF AMORPHOUS MAGNETIC ALLOY AND A METHOD FOR MANUFACTURING THE SAME

BACKGROUND OF THE INVENTION

1. Field of the Invention

The present invention relates to a magnetic core, more particularly to a saturable core which comprises a wound amorphous alloy sheet. The present invention also relates to a method for manufacturing such a magnetic core.

2. Description of the Prior Art

It is known to use a saturable core in a particle accelerator, a magnetic modulator for a low-impedance discharge laser, a power switch, a pulse generator, and the like.

FIGS. 1 and 2 illustrate an equivalent circuit of a saturable core used for a particle accelerator and the hysteresis loop of the saturable core, respectively. In FIG. 1, $L_1$, $L_2$, ——— $L_n$ denote saturable inductors. $C_1$, $C_2$, ——— $C_n$ denote capacitors which have capacitances equal to each other. The inductance of inductors $L_1$, $L_2$, ———, $L_n$ is at a high stage of the LC circuit. Direct current is applied to the input of the equivalent circuit and is first loaded in the capacitor $C_1$. When the capacitor $C_1$ is loaded and the saturable inductor $L_1$ is saturated, the impedance of the saturable inductor $L_1$ is decreased, with the result that the electric charge loaded in the capacitor $C_1$ is conducted into the capacitor $C_2$, which is then loaded in turn. The above described loading of a capacitor and saturation of a saturable inductor occur succcessively in the first, second, and n-th stage of the LC circuit, while maintaining the energy of an input current wave and simultaneously successively compressing the pulse width. As a result, a high power pulse having a short pulse width is generated. The saturable inductors $L_1$, $L_2$, ———, $L_n$ comprise a saturable core.

A saturable core must, first, have a good saturation property, that is, a high squareness ratio and a low permeability at a saturation region of the hysteresis loop (hereinafter referred to as $\mu$sat). The present inventors investigated the saturation property and concluded that when the ratio $Br/B_{10}$ is at least 0.7, a good saturation property is obtained. Here, Br is the residual flux density, and $B_{10}$ is the magnetic flux density at magnetizing a field of 10 Oe, as shown in FIG. 2. Since $\mu$sat is proportional to the volume of the saturable core, and vice versa, when $\mu$sat is small, the saturable core is advantageously small sized.

The theoretical maximum compression coefficient of the pulse width is proportional to $(\mu\text{unsat}/\mu\text{sat})^{\frac{1}{2}}$, wherein $\mu$unsat indicates the permeability at the unsaturated region of the hysteresis loop. Thus, the greater the difference between $\mu$unsat and $\mu$sat, the higher the theoretical maximum compression coefficient of pulse width, with the result that the number of stages of the LC circuit can be decreased and, thus, the magnetic switch can be made smaller.

Since a saturable core must, second, be energized or magnetized, as shown in FIG. 2 in such a manner that its magnetic flux density increases from $-Br$ to Bs of the hysteresis loop, the $\Delta Bs$ ($|-Br|+Bs$) must be great. The time required for increasing the magnetic flux density from $-Br$ to Bs is referred to as the switching time.

A saturable core must, third, have a low power loss (watt loss) at a high frequency, since the saturable core is energized or magnetized under an alternating current having a frequency of approximately 10 kHz or more. The power loss is generally proportional to the thickness of the material and is influenced by its composition.

A saturable core must, fourth, be resistant to secular changes of magnetic properties.

Conventional saturable cores are made of ferrite, crystalline nickel-iron alloys, or other crystalline alloys. Recently, amorphous alloys, also referred to as "metallic glasses", "ferromagnetic amorphous metals", and the like depending on the technical field, have also attracted attention as materials for saturable cores. Amorphous alloys have high resistivities, therefore, low power loss, compared to the crystalline nickel-iron alloys and have high saturation inductions together with high squareness ratios.

C. H. Smith et al, in "Amorphous Metal Reactor Cores for Switching Applications". Proceedings of the 3rd International Power Conversion Conference, Munich (September 1981), disclosed several amorphous alloys pertinent to saturable cores, i.e., a 33 $\mu$m thick $Fe_{67}Co_{18}B_{14}Si_1$ sheet and a 30 $\mu$m thick $Fe_{81}B_{13.5}Si_{3.5}C_2$ sheet. M. Stockton et al in "Pulsed Power Switching Using Saturable Core Inductors", Journal of Applied Physics 53 (3) (March 1982), discloses single-turn saturable cores constructed of $Fe_{67}Co_{18}B_{14}Si_1$ amorphous alloy for switching fast, high-power pulses. Such saturable cores, however, do not satisfy all of the four properties described above.

Carl H. Smith, in "Metallic Glasses for Magnetic Switches, IEEE Conference Record of 15th Power Modulator Symposium, June 14 to 16, 1982, Baltimore, Md., Pages 22 to 26", discloses the necessity of insulation to reduce short-circuiting and inter-laminar eddy current and also insulation methods, such as coating and insertion of a separate inter-laminar layer with margins.

Saturable cores are manufactured by winding an amorphous alloy sheet, e.g., in the form of a toroid. Inter-layer short-circuiting is likely to occur in the saturable core, since the magnetic flux density instantaneously changes and a high voltage which is proportional to that change is generated when a high frequency current is applied to the saturable core.

For a transformer core, a silicon steel sheet is high-temperature annealed and a glass film is formed on it during the annealing. An insulation film is then applied on the silicon steel sheet and baked. However, since the saturable core comprises a wound amorphous alloy sheet, and since amorphous alloy is much less thermally stable than silicon steel, the insulation film used for silicon steel sheet cannot be employed for the layer insulation of a wound amorphous alloy sheet.

The layer insulation of a wound amorphous alloy sheet is conventionally carried out by applying MgO or another insulating material. The method for applying the insulating material is not practical, however, since the edges of an amorphous alloy sheet are sharp and, thus, are not covered by the insulating material. Thus, short-circuiting is likely to occur between the edges of neighboring layers of an amorphous alloy sheet.

Layer insulation of a saturable core is also conventionally carried out by winding a polyimide or polyethyleneterephthalate film together with a amorphous alloy sheet, thereby inserting the film between the layers. Since polyimide or the like is not very heat resistant, however, it cannot withstand the heat treatment meant to improve the magnetic properties, especially ΔBs, of an amorphous alloy sheet, which treatment is carried out at a temperature below the crystallization temperature and ranges from 300° C. to 500° C. Therefore, the amorphous alloy sheet must first be heat treated and then wound together with a film of polyimide or the like to obtain the layer insulation.

Carl H. Smith also discloses 18 μm thick iron based ribbons as saturable cores. Although 18 μm thick iron-based ribbons have occasionally been produced, however, and they feature relatively low power loss, they are not totally satisfactory in the other three properties.

SUMMARY OF THE INVENTION

It is an object of the present invention to provide a saturable core having a low power loss at a high frequency, e.g., 10 kHz in which a high ΔBs and an excellent layer insulation are simultaneously attained and in which secular change of the magnetic properties is reduced.

It is another object of the present invention to provide a saturable core having a low μsat of, for example, from 1 to 10, and/or a high $(\mu unsat/\mu sat)^{\frac{1}{2}}$ amounting to 500 or more, thereby enabling a small size.

It is still another object of the present invention to provide a saturable core made of an amorphous alloy which can be heat treated under less strict conditions than in the prior art.

It is still another object of the present invention to provide a method for manufacturing a saturable core simultaneously attaining an excellent layer insulation and a high ΔBs.

The present inventors made extensive studies to attain the above-mentioned objects. As a result, the present inventors found that the above-mentioned objects can be attained by a saturable core consisting of a coiled thin strip of an amorphous magnetic alloy having a predetermined coiling direction and thickness.

A saturable core according to an aspect of the present invention comprises: a thin strip of amorphous magnetic alloy coiled in the same coil direction as during heat treatment and an insulating film inserted between and insulating layers of the coiled thin strip.

A saturable core according to another aspect of the present invention consists of a coiled thin strip of an amorphous magnetic alloy, preferably one partially containing fine crystals, have a thickness of 20 μm or less, preferably from 5 μm to 18 μm. A preferable composition of the amorphous alloy is one of the following formulas (I) through (V):

$$Fe_x(Si_tB_q)_y \quad [I]$$

wherein x+y is 100 atomic % based on all of the elements; y is from 21 to 25.5 atomic %; t+q is 1; t is from 0.40 to 0.75; and $y \leqq 50t+1$, $y \leqq 10t+19$, $y \geqq 30t+2$, and $y \geqq 13.3t+13.7$.

$$Fe_x(Si_tB_qX_r^I)_y \quad [II]$$

wherein $X^I$ represents at least one member selected from P and C; x+y is 100 atomic % based on all of the elements; y is from 21 to 25.5 atomic %; t+q+r is 1; t is from 0.40 to 0.75; r is from 0.0001 to 0.24; and $y \leqq 50t+1$, $y \leqq 10t+19$, $y \geqq 30t+2$, and $y \geqq 13.3t+13.7$.

$$(Fe_aT_b^I)_xX_y \quad [III]$$

wherein $T^I$ represents Co and/or Ni; X represents a combination of Si and B or a combination of Si, B, P, and/or C; x+y is 100 atomic % based on all of the elements; y is from 21 to 25.5 atomic %; a+b is 1; b is from 0.001 to 0.20; when the Si content in X is represented by t, t is from 0.40 to 0.75 and $y \leqq 50t+1$, $y \leqq 10t+19$, $y \geqq 30t+2$, and $y \geqq 13.3t+13.7$; and, when X includes P and/or C, the sum of P and C is from 0.0001 to 0.24.

$$(T^{II}_eMn_d)_xX_y \quad [IV]$$

wherein $T^{II}$ represents Fe or a combination of Fe, Co, and/or Ni; X represents a combination of Si and B or a combination of Si, B, P, and/or C; x+y is 100 atomic % based on all of the elements; y is from 21 to 25.5 atomic %; e+d is 1; d is from 0.001 to 0.05; when $T^{II}$ includes Co and/or Ni, the sum of Co and Ni is from 0.001 to 0.20; when the Si content in X is represented by t, t is from 0.40 to 0.75 and $y \geqq 50t+1$, $y \geqq 10t+19$, $y \geqq 30t+2$, and $y \geqq 13.3t+13.7$; and, when X includes P and/or C, the sum of P and C is from 0.0001 to 0.24.

$$(T^{III}_gT^{IV}_f)_xX_y \quad [V]$$

wherein $T^{III}$ represents Fe or a combination of Fe and at least one member selected from Co, Ni, and Mn; $T^{IV}$ represents at least one member selected from the Group VIA elements of the Periodic Table; X represents a combination of Si and B or a combination of Si, B, P, and/or C; x+y is 100 atomic % based on all of the elements; y is from 21 to 25.5 atomic %; g+f is 1; f is from 0.001 to 0.07; when $T^{III}$ includes Co and/or Ni, the sum of Co and Ni is from 0.001 to 0.20; when $T^{III}$ includes Mn, Mn is from 0.001 to 0.05; when the Si content in X is represented by t, t is from 0.40 to 0.75 and y is $y \leqq 50t+1$, $y \leqq 10t+19$, $y \geqq 30t+2$, and $y \geqq 13.3t+13.7$; and, when X includes P and/or C, the sum of P and C is from 0.0001 to 0.24.

The composition [V] partially overlaps the amorphous alloy composition of a choke coil disclosed in U.S. patent application Ser. No. 443,923, filed by Shigeta (one of the present inventors) and Takayama.

The method for manufacturing a saturable core according to the present invention is characterized by: coiling a thin strip of amorphous magnetic alloy in such a manner that a first end and second end are positioned inward and outward, respectively, thereby forming a first coil; heat treating the first coil; coiling an insulating film and the thin strip of amorphous alloy in such a manner that its first end and second end are positioned inward and outward, respectively, thereby forming a second coil; and providing the second coil with an inner diameter which is essentially equal to the inner diameter of the first coil.

BRIEF DESCRIPTION OF THE DRAWINGS

The objects, advantages, and effects of the present invention will be clearer from the ensuing description made in reference to the attaching drawings, wherein.

DESCRIPTION OF THE PREFERRED EMBODIMENTS

Figure 1:
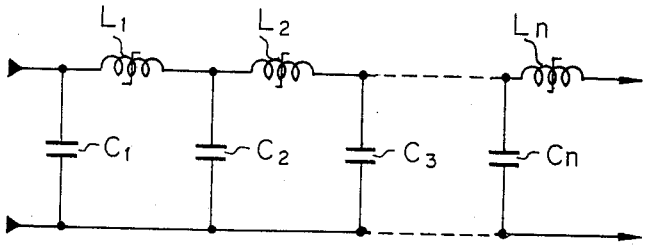
Fig. 1 PRIOR ART
FIG. 1 illustrates an equivalent circuit of a magnetic switch used for a particle accelerator.
Figure 2:
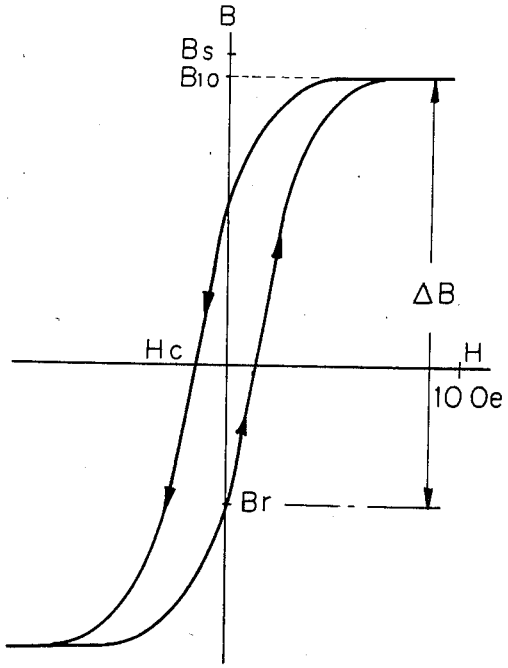
Fig. 2 PRIOR ART
FIG. 2 illustrates a hysteresis loop of a saturable core.
Figure 3:
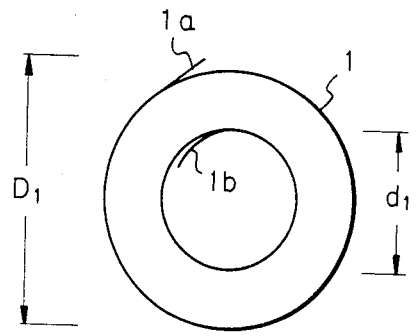
FIG. 3 illustrates an embodiment of a first core, i.e., a core of a coiled thin strip of amorphous magnetic alloy.
Figure 4:
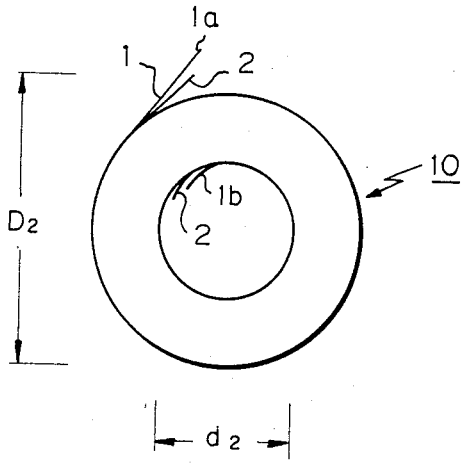
FIG. 4 illustrates an embodiment of a second core, i.e., a saturable core having a specified coil direction.
Figure 5:
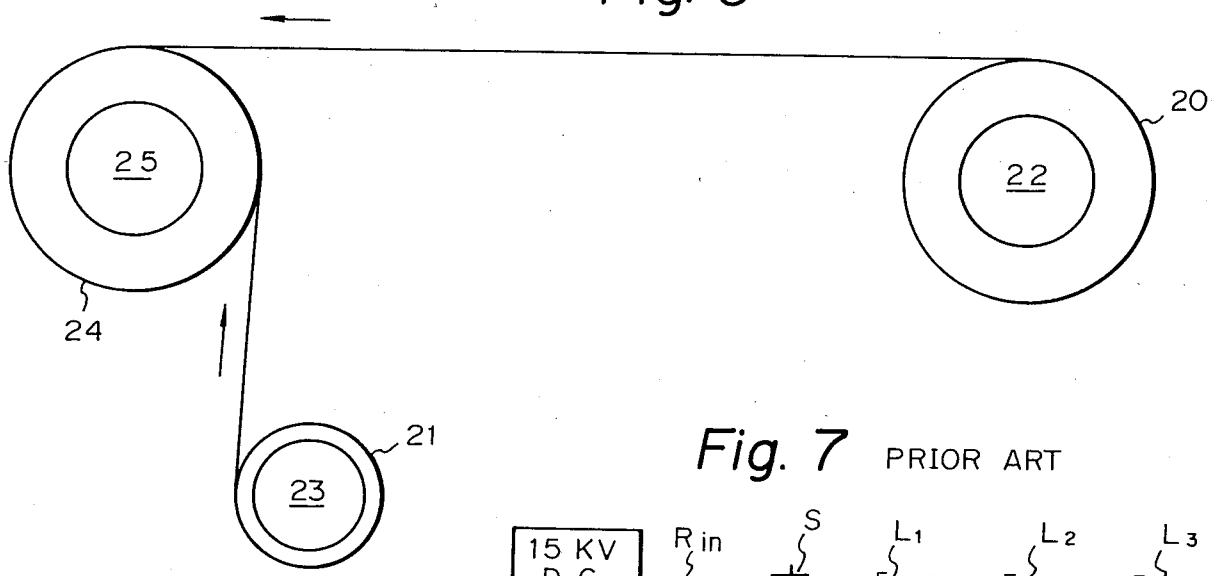
FIG. 5 illustrates a method for forming the second core.

An embodiment of the saturable core having the specified coiling direction is illustrated in FIGS. 3 through 5.

In FIG. 3, a thin strip of amorphous alloy is coiled to form a first coil 1. The inner and outer diameters of the first coil 1 are denoted by $d_1$ and $D_1$, respectively. First and second ends of the thin strip of amorphous alloy are denoted by 1*b* and 2*a*, respectively, and are positioned at the inner and outer sides of the first coil 1.

The first coil 1 is then loaded in a furnace (not shown) for heat treatment. The heat treatment is carried out at a temperature of 300° C. to 500° C. for 30 minutes to 10 hours. The heat treatment temperature and time is adjusted depending upon the composition of the amorphous magnetic alloy so as to attain the best magnetic properties, particularly ΔBs.

The heat treatment of the first coil 1 may be carried out under a non-magnetic field, but is usually carried out with the coil 1 under a magnetic field having an intensity of 5 Oe or more, preferably 10 Oe or more. When such magnetic annealing is carried out, the temperature must be lower than the Curie point of the amorphous magnetic alloy. The heat treatment atmosphere may be air, vacuum, inert gas or a non-oxidizing gas. After the heat treatment, the first coil 1 is cooled, for example, by air cooling.

As a result of the magnetic annealing, a magnetic anisotropy is induced in the longitudinal direction of and parallel to the surface of a thin strip of amorphous magnetic alloy.

The first coil 1 does not include an insulating film, since such a film cannot withstand the temperature of the heat treatment. The first coil 1 is therefore uncoiled and rewound, as shown in FIG. 4, with an insulating film 2 inserted between its layers to form a second coil 10. At this stage, the outer diameter $D_2$ of the second coil 10 is usually greater than the outer diameter $D_1$ of the first coil (FIG. 3) because of the insulating film 2. In the second coil 10, the first end 1*b* and the second end 1*a* must be positioned at the inner side and outer sides, respectively, as in the first coil 1. Also, the inner diameter $d_2$ of the second coil 10 must be made essentially the same as the inner diameter $d_1$ of the first coil 1.

If the first end 1*b* (the second end 1*a*) of the thin strip is positioned outside (inside) of the coil or if the inner diameter $d_2$ of the second coil 10 differs significantly from the inner diameter ($d_1$) of the first coil 1, ΔBs is considerably low. Desirably, $$\Delta d = \frac{d_2 - d_1}{d_1} \times 100\%$$

is from −20% to +40%. In this case, ΔBS of at least 2.5 T can be obtained. When Δd is 0%, ΔBs is the highest.

An example of the formation of the second coil is schematically illustrated in FIG. 5. Reference numeral 20 represents a thin strip of amorphous magnetic alloy which has been heat treated. Reference numeral 21 represents an insulating film. The thin strip 20 and the insulating film 21 are wound around reels 22 and 23, respectively, the thin strip being wound in a direction opposite to that during its heat treatment. The thin strip 20 and the insulating film 21 are progressively coiled around a reel 25, thereby laminating them with each other, and forming a second coil 24. During the coiling, a predetermined tension, usually a few grams force, is applied to the thin strip 20 and the insulating film 21.

The strip layers are separated from each other by the insulating film 21 having a thickness of from 0.1 to 25 μm, preferably from 2 to 6 μm. An insulating gap formed by the insulating film 21, however, is not sufficient to prevent electric discharge between the edges of the strip layers. Therefore, the insulating film 21 should be slightly wider than the thin strip 20. Based on the air discharge condition, the induced voltage, and the condition of use of saturable cores, for example, use as magnetic switches; the size of the thin strip 20; and the size of the saturable cores, the insulating film 21 should be wider than the thin strip 20 by at least 10 μm at one side. As the thin strip 20 inevitably vibrates horizontally during coiling, the insulating film 21 is preferably wider by at least 2 mm at one side, preferably from 3 to 5 mm.

After forming the second coil 24, the second end (not shown) of the thin strip 20 is fixed to the outermost portion of the coil 24 by an adhesive, welding, or tape. Alternatively, it may be caulked using a caulking claw (not shown) provided on the reel 25.

A saturable core according to the present invention consists of a coiled thin strip of an amorphous magnetic alloy. The thin strip consists of a transition metal component and a metalloid element component. Preferable compositions of amorphous magnetic alloys are hereinafter described. The transition metal component comprises, as an essential element, Fe (formula [I] and [II]) and, as options, Co and/or Ni (formula [III]); Mn and, if necessary, Co and/or Ni (formula [IV]); an element of Group VIA of the Periodic Table, i.e., Cr, Mo, or W, and Co, Ni, and/or Mn (formula [V]).

Co is effective for enhancing the ΔBs and reducing the volume of the saturable core. Ni is effective for making the heat treatment easy, providing a high squareness ratio and a high ΔBs, and reducing the volume of the saturable core. The Co and/or Ni content in the transition metal component, assuring the content of the transition metal component is 1, should be 0.001 to 0.20. When the Co-Ni ratio is more than 0.20, the power loss becomes great. The Co content in the transition metal component is preferably 0.001 to 0.10. The Ni content is preferably from 0.001 to 0.15.

Mn is effective for decreasing the secular change in the magnetic properties, for increasing the crystallization temperature and for relaxing restrictions on the temperature and time required for the heat treatment for precipitating fine crystals. The Mn content in the transition metal component, assuming the total content of the transition metal component is 1, should be 0.001 to 0.05. If it is more than 0.05, the Bs is reduced, a secular change in the magnetic properties is likely to occur, in the magnetic properties, and the formation of a thin strip is difficult. The Mn content is preferably from 0.001 to 0.03.

One or more elements of Group VIA of the Periodic Table, i.e., Cr, Mo, and W are effective for reducing a secular change in the magnetic properties and for enhancing the corrosion resistance. The Group VIA element content in the transition element component, assuming the total content is 1, should be 0.001 to 0.07. If it is more than 0.07, the ΔBs is drastically decreased and the formation of the thin strip is difficult. The content is preferably from 0.001 to 0.04.

One or more transition metallic elements other than those described above, e.g., (Sc-Zn, Y-Cd, La-Hg, Ac, elements having atomic numbers greater than Ac, as well as Cu, Nb, Ti, V, Zr, Ta, and Y, may be also contained in the amorphous magnetic alloy, provided that the total content of these transition metallic elements in the transition metal component, assuming that the content of the transition metal component is 1, is no more than 0.10, more preferably, no more than 0.05.

The metalloid element component comprises Si and B, and, occasionally, P and/or C (formulae [II] through [V]).

The content y of the metalloid element component is from 21.0 to 25.5 atomic %. If the content y is more than 25.5 atomic %, the power loss becomes appreciable and the magnetic properties are deteriorated. Since the magnetic properties are deteriorated, in order to obtain the identical magnetic properties, the volume of the saturable core would then have to be increased. If the content y is less than 21.0 atomic %, the formation of the thin strip becomes difficult, the yield becomes inferior, and the surface roughness of the thin strip is increased. Moreover, the crystallization temperature is lowered, and the temperature and the time of the heat treatment must be severely restricted.

The content of Si in the metalloid element component, assuring the content of the metalloid element component 1, is from 0.40 to 0.75. If it is less than 0.4, the power loss is great and the secular change in magnetic properties becomes great. If it is more than 0.75, the formation of the thin strip becomes difficult, the yield becomes inferior, and the surface roughness of the thin strip is increased.

Figure 6:
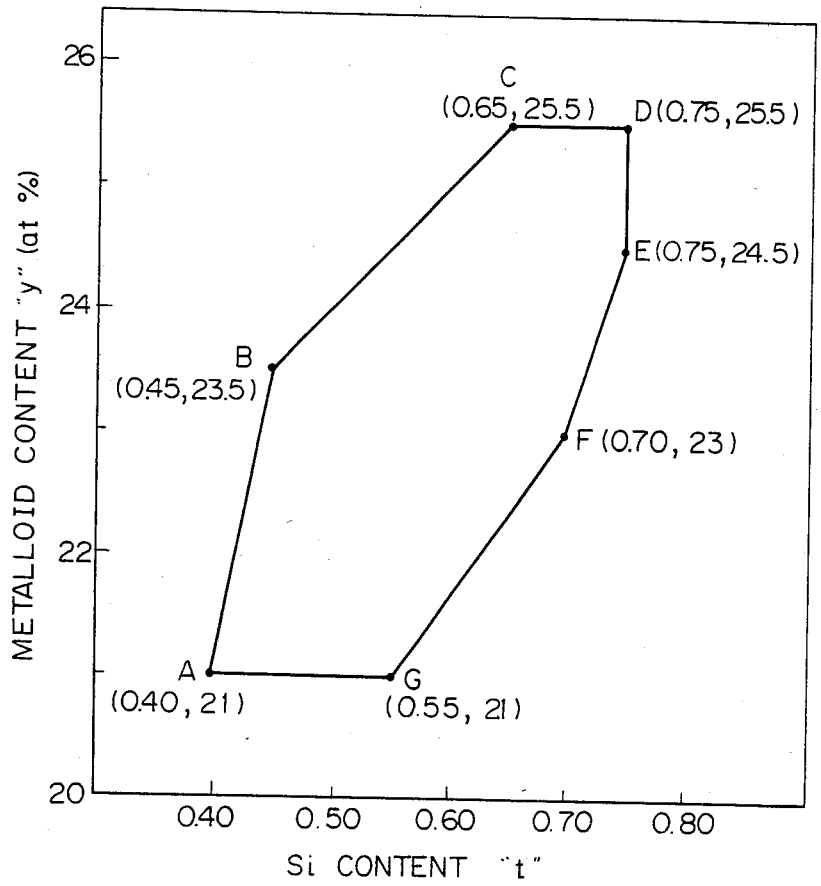
FIG. 6 is a t-y coordinate diagram of the relationship between an Si content "t" in metalloid element components and a content "y" of the metalloid element components according to the present invention.

In addition, the relationships $y \leqq 50t+1$, $y \leqq 10t+19$, $y \leqq 30t+2$, and $y \leqq 13.3t+13.7$ should be satisfied between the total content y in atomic % and the Si content t. These conditions are expressed in the coordinate (t, y) shown in FIG. 6. In FIG. 6 the points A(0.4, 21.0), B(0.45, 23.5), C(0.65, 25.5), D(0.75, 25.5), E(0.75, 24.5), F(0.70, 23.0), G(0.55, 21.0), and A(0.40, 21.0) are connected by straight lines to form a heptagon. It is necessary that y and t be on or within the heptagon. The line AB corresponds to $y=50t+1$ and the line BC corresponds to $y=10t+19$. These lines are critical for providing a low power loss at a high frequency region, a small core volume, and a small secular change. The line EF corresponds to $y=30t+2$, and the line FG corresponds to $y=13t+13.7$. These lines are critical for easily obtaining the thin strip and for precipitating fine crystals under non-severe heat treatment conditions.

When the amorphous magnetic alloys contain P and/or C (formulas III to V), the power loss is considerably low and ΔBs will not decrease with the lapse of time. The content of P and/or C in the metalloid element component, assuming the content of the metalloid element component is 1, is in the range of from 0.0001 to 0.24. The presence of both P and C is more preferable than the presence of P or C alone. The P content in the metalloid element component is preferably in the range of from 0.0001 to 0.05, more preferably from 0.0001 to 0.02. The ratio of the C content to the P content is preferably in the range of from 0.0005 to 0.004, which enables a considerably low power loss, a considerably small secular change in ΔBs, and very easy formation of the thin strip.

The metalloid element components may contain, in addition to the above-mentioned elements, one or more additional elements selected from Al, Be, Ge, Sb, and In. However, it is necessary that the total content of these additional elements in the metalloid element component be 0.10 or less. If the total content of the additional elements is more than 0.10, the magnetic properties become inferior.

The coiled thin strip is made of a lengthy strip having a thickness of 20 μm or less and a width of preferably, 10 to 200 mm, more preferably 12.7 to 127 mm. Since the thickness is not more than 20 μm, the amount of heat generated is small, i.e., the power loss at a high frequency is small. The thickness of the strip is preferably 5 to 18 μm, more preferably 8 to 15 μm. When the thickness is less than 5 μm the formation of the thin strip is difficult and the yield becomes poor.

According to a discovery by the present inventors, in order to stably form a 20 μm or less thick thin strip of amorphous magnetic alloy. The alloy composition should be such that the structure is relatively resistant against vitrification but is vitrified finally.

The structure of amorphous magnetic alloy is preferably partially crystalline. In this structure, fine crystals are precipitated in the amorphous phases. An X-ray diffraction spectra of such a thin strip has a peak indicating the presence of crystals superimposed on a halo characteristic of amorphous phases. The spectra also has spots superimposed on the halo and a Debye-Scherrer ring having a predetermined diameter and width. The ratio of the crystal to the amorphous phase, determined by the ratio in area between the halo and the peak of the diffraction spectra, is preferably in the range of 0.001 to 0.5. Judging from the diameter and width of the Dehye-Scherrer ring, the precipitated fine crystals are usually considered to have an average grain diameter of from 10 to 1000 Å.

In a thin strip of amorphous magnetic alloy in which fine crystals are partially precipitated, magnetic anisotropy is induced in a predetermined direction or directions parallel to the sheet surface, thereby effectively enhancing μunsat and the maximum coefficient of pulse width, further reducing the power loss, and attaining easy adjustment of the magnetic properties, especially the squareness ratio and the μunsat/μsat. The magnetic anisotropy is preferably a one-axis magnetic anisotropy which is induced in one predetermined direction parallel to the sheet surface. When a thin strip of an amorphous magnetic alloy is heat-treated while imparting a magnetic field to the strip, thereby forming precipitated fine crystals, a one-axis magnetic anisotropy is induced along the longitudinal axis of the strip.

In heating the thin strip, the strip must be first coiled. Heat treatment in an extended flat state followed by later coiling to form a saturable core results in deteriorated magnetic properties. The final saturable core must be coiled in the same direction as the coiling during heating. This does not mean, however, that the thin strip may not be flattened or coiled in the other direction after heating and before completion of the saturable core. Even if the thin strip is flattened or coiled in reverse between such steps, the magnetic properties are not deteriorated so long as the final saturable core is coiled correctly. The coiling direction during heating can give a curl tendency which can also be detected in a saturable core.

The saturable core according to the present invention should also have an insulating film inserted between and insulating layers of the coiled thin strip. Here, the term "layers" means the successively laminated portions of the coiled thin strip.

The saturable core according to the present invention according to the present invention can be effectively used for a magnetic switch, a laminated core which is energized by a magnetic switch so as to accelerate ions or particles, a high frequency magnetic amplifier, and other magnetic devices, in which the saturable property of a hysteresis loop is utilized. N. C. Christofilos et al, in "High Current Linear Induction Accelerator for Electrons", THE REVIEW OF SCIENTIFIC INSTRUMENTS, Vol. 35, No. 7, page 886, July, 1964, reports the magnetic induction principle, in which the laminated core and switch are electrically connected with each other by a primary loop, thereby accelerating an electron beam when it passes through the central aperture of the laminated core. Advantageously, the saturable core of the present invention is used for both the laminated core and the switch disclosed by N. C. Christofilos et al.

The present invention is hereinafter described with reference to the following examples.

EXAMPLE 1

A 15 μm thick and 25.4 mm wide thin strip having a composition of $(Fe_{0.949}Mn_{0.051})_{78}(Si_{0.591}B_{0.273}C_{0.091}P_{0.045})_{22}$ was coiled to form a first coil having an outer diameter $D_1$ (FIG. 3) of 127 mm and an inner diameter $d_1$ of 76 mm. The first coil was heat treated at 400° C. for 2 hours under a magnetic field of 30 Oe. The obtained ΔBs was 2.7 T.

The thin strip was coiled, in the direction opposite to that during heating, while interposing a 2 μm thick polyethyleneterephthalate film between the strip layers so as to form a coil having an inner diameter of $d_1$ 76 mm. ΔBs was 1.9 T. In another test, the thin strip was coiled, in the same direction as that during heating, while interposing a 2 μm thick polyethyleneterephthalate film between the strip layers, so as to form a second coil having the inner diameter ($d_2$) and outer diameter ($D_2$) as varied in Table 1.

TABLE 1

| Test pieces | | $D_2$ (mm) | $d_2$ (mm) | ΔBs (T) | Δd (%) |
|---|---|---|---|---|---|
| 1 | | 168 | 127 | 2.4 | 67.1 |
| 2 | Invention | 147 | 102 | 2.6 | 34.2 |
| 3 | Invention | 127 | 76 | 2.7 | 0 |
| 4 | Invention | 124 | 64 | 2.6 | −15.8 |
| 5 | | 119 | 51 | 2.3 | −32.9 |
| 6 | | 112 | 25 | 1.8 | −67.1 |

EXAMPLE 2

Two 25.4 mm-wide and a 15 μm-thick strips of an amorphous magnetic alloy, hereinafter referred to as thin strips, were formed by means of a known liquid rapid-cooling method. One of the thin strips had a composition A of the present invention, $Fe_{78}(Si_{0.5}B_{0.5})_{22}$, while the other had a composition B outside the present invention, $Fe_{78}(Si_{0.5}P_{0.5})_{26}$. The two thin strips were almost completely vitrified, i.e., were almost completely amorphous.

Each of the strips was cut into five pieces. One of each of the five pieces was not heat-treated. The other eight pieces were heat-treated under the conditions given in Table 2. Pieces A-3 and A-4 constitute the present invention.

TABLE 2

| Test pieces | Time | Magnetizing | X-ray Diffraction |
|---|---|---|---|
| A-1 | — | — | Halo Pattern Only |
| A-2 | 300° C., 180 minutes | 20 Oe | Halo Pattern Only |
| A-3 | 350° C., 120 minutes | 20 Oe | Halo Pattern + Diffraction Peak |
| A-4 | 400° C., 90 minutes | 20 Oe | Halo Pattern + Diffraction Peak |
| A-5 | 450° C., 30 minutes | 20 Oe | Diffraction Peak Only |
| B-1 | — | — | Halo Pattern Only |
| B-2 | 300° C., 180 minutes | 20 Oe | Halo Pattern Only |
| B-3 | 350° C., 120 minutes | 20 Oe | Halo Pattern + Diffraction Peak |
| B-4 | 400° C., 90 minutes | 20 Oe | Halo Pattern + Diffraction Peak |
| B-5 | 450° C., 30 minutes | 20 Oe | Diffraction Peak Only |

The two non-heat-treated pieces and the eight heat-treated pieces were subjected to X-ray diffraction. As apparent from Table 2, the virtually completely vitrified thin strips were continuously converted to completely crystalline thin strips in accordance with an increase in the heat-treatment teperature.

EXAMPLE 3

Ten pieces of thin strips identical to those of Example 2 were formed and eight pieces were heat treated in the same manner as in Example 2.

The ten pieces were each coiled, together with a 10 μm thick polyethylene terephthalate film, into a toroid having an inner diameter of 76.2 mm, an outer diameter of 127 mm, and a height of 127 mm. Each of the coils was provided with a winding of two turns, thereby forming a saturable core having an inductance of from 5 to 40 μH.

Figure 7:
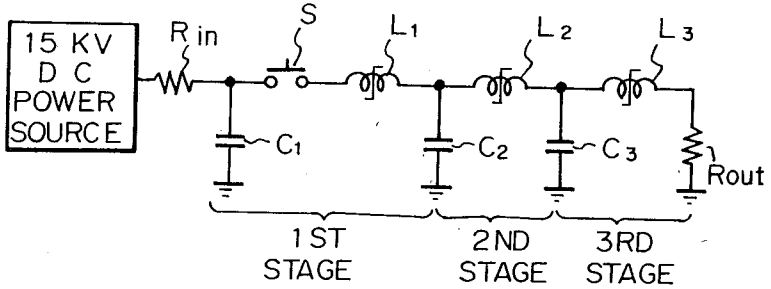
Fig. 7 PRIOR ART
FIG. 7 is a circuit diagram by which the effect of the saturable cores of the present invention was confirmed in example 2.

Then, each of the saturable cores was set in the circuit of a magnetic switch shown in FIG. 7 as the saturable inductor $L_3$ of the third-stage of the magnetic switch.

In FIG. 7 each stage of the magnetic switch is designed so that the following relationship is established:

$$L_n\text{saturated} >> L_{n+1}\text{Unsaturated } (n=1 \text{ or } 2),$$

thereby making it impossible to return power to the preceding stage.

In the circuit shown in FIG. 7, the first stage capacitor $C_1$ (20 nF) was charged at a voltage of 15 kV across a resistor having a resistance Rin of $10^7\Omega$ by means of a source of direct currrent. After the charging procedure was completed, the switch S was closed so as to initiate pulse transmission. When the saturable inductor $L_1$ (2,000 μH) is saturated, the energy charged in the capacitor $C_1$ is transmitted from the inductor $L_1$ to the capacitor $C_2$ (20 nF) and the saturable inductor $L_2$ (200 μH) of the second stage. Then, when the saturable inductor $L_2$ is saturated, the energy charged in the capacitor $C_2$ is transmitted to the capacitor $C_3$ (20 nF) and the saturable inductor $L_3$ of the third stage.

When the inductor $L_3$ is saturated, the energy charged in the inductor $L_3$ is applied to the resistance load Rout (1.6Ω) through the inductor $L_3$, where the energy is consumed as heat.

The results of tests for power loss at the saturable inductor $L_3$ are shown in Table 3.

TABLE 3

| Test piece | | Power loss (J) | Secular change |
|---|---|---|---|
| A-1 | | 0.29 | x |
| A-2 | | 0.15 | Δ |
| A-3 | Invention | 0.10 | o |
| A-4 | Invention | 0.09 | o |
| A-5 | | 1.82 | o |
| B-1 | | 0.62 | x |
| B-2 | | 0.33 | Δ |
| B-3 | | 0.22 | Δ |
| B-4 | | 0.20 | Δ |
| B-5 | | 1.87 | o |

The cores were soaked in a constant temperature bath of 120° C. for 1,000 hours. After soaking, the power loss was determined in the same manner as mentioned above so as to evaluate a secular change in the power loss. The results are also shown in Table 3. In the table, the symbol x indicates that there was a great change, the symbol Δ indicates that there was a moderate change, and the symbol o indicates that the there was little change.

It is apparent from Table 3 that the thin strips, according to the present invention, of an amorphous magnetic alloy having the formula [I] and partially containing precipitated fine crystals exhibit excellent effects when used as a core for a magnetic switch.

EXAMPLE 4

Thin strips were formed from amorphous magnetic alloys having the formula [I] wherein the amount y of the metalloid element component and the ratio t of the Si content in the metalloid element component were varied.

The thin strips were heat-treated at a temperature of 400° C. for 2 hours while applying a magnetic field of 20 Oe to the strips in the longitudinal direction thereof.

As a result of the above-mentioned heat treatment, the thin strips all exhibited an X-ray diffraction spectra having a halo pattern and a diffraction peak.

Then, the thin strips were each coiled into a toroid having an inner diameter of 76.2 mm, an outer diameter of 127 mm, and height of 25.4 mm, similar to the toroid described in example 2, while interposing a 10 μm-thick polyethylene terephthalate film between the strip layers. Thus, cores were obtained.

Each core was set in the circuit of a magnetic switch shown in FIG. 7 as the saturable inductor $L_3$, as in Example 2, and the power loss was determined. Each core had an inductance of from 15 to 40 μH.

Figure 8:
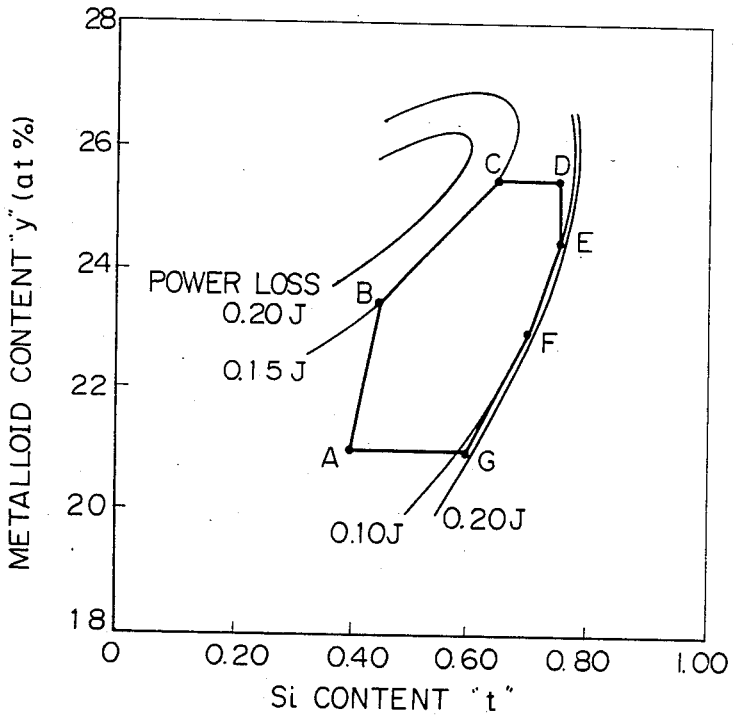
FIG. 8 is a graph of compositional ranges of power losses of 0.10 J, 0.15 J, and 0.20 J.

The results of the measurement of the power loss are shown in FIG. 8. In FIG. 8, the Si content "t" in the metalloid element component of the thin strip is indicated on the abscissa and the amount y of the metalloid element component is indicated on the ordinate. FIG. 8 shows compositional lines in which the power losses of the cores obtained from the thin strips in which y and t are varied are 0.1 J, 0.15 J, and 0.2 J, respectively.

It is evident from FIG. 8 that the cores obtained from thin strips of the present invention, i.e., those having a composition falling within the region surrounded by A-B-C-D-E-F-G-A or on the A-B-C-D-E-F-G-A line, exhibit a power loss of approximately 0.15 J or less, while the cores obtained from thin strips outside the present invention, i.e., those having a composition outside the above-mentioned region, exhibit great power loss.

The voltage applied between both ends of each core was determined and the ΔBs of the core calculated from the following equation:

$$\int VL_3 dt \approx \langle VL_3 \rangle x\tau = N \cdot A \cdot \Delta Bs$$

wherein $VL_3$: the voltage applied to the core $\tau$: the time for which the voltage is applied N: the winding of the core, in this case, N=2 turns The relation percentage of core volume to the core volume as ΔBs=3 T was determined from the relationship between the calculated Bs and the core volume required for transmitting the same power:

$$[(\text{power})/(\text{core volume})] \alpha\ (\Delta Bs)^2$$

Figure 9:
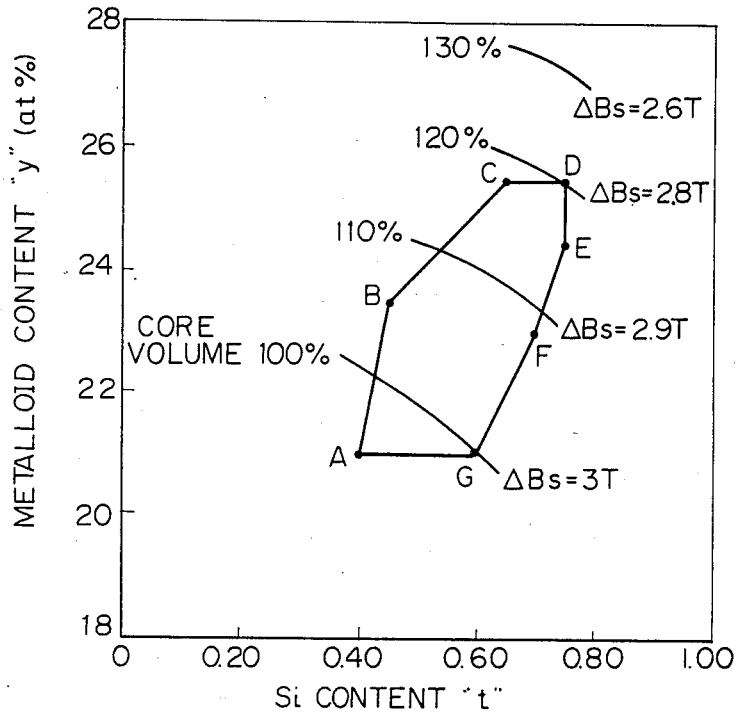
FIG. 9 is a graph of compositional ranges of exhibiting identical ΔBs and core volume.

Compositional lines indicating the relationship between the ΔBs and the relative core volume are shown in FIG. 9.

It is evident from FIG. 9 that the cores of the present invention exhibit a remarkably high ΔBs and the core volume can be made small.

Figure 10:
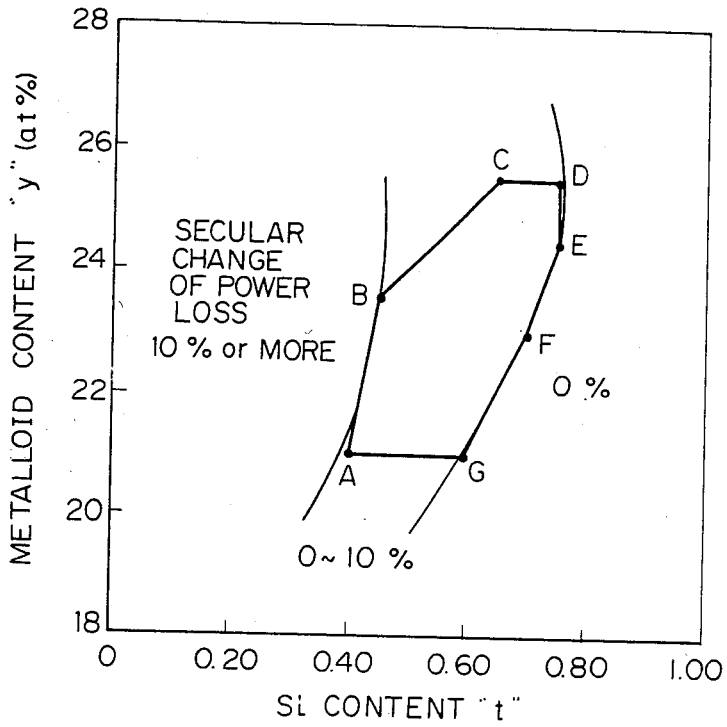
FIG. 10 is a graph of compositional ranges exhibiting ranges of secular change of power less.

Moreover, as in Example 3, the cores were soaked in a constant temperature bath of 120° C. for 1,000 hours and, thereafter, were set in the circuit in the same manner as described above. Then, a secular change in the power loss was determined. The results are shown in FIG. 10. It is evident from the results shown in FIG. 10 that the cores of the present invention exhibit a remarkably excellent secular change characteristic.

Figure 11:
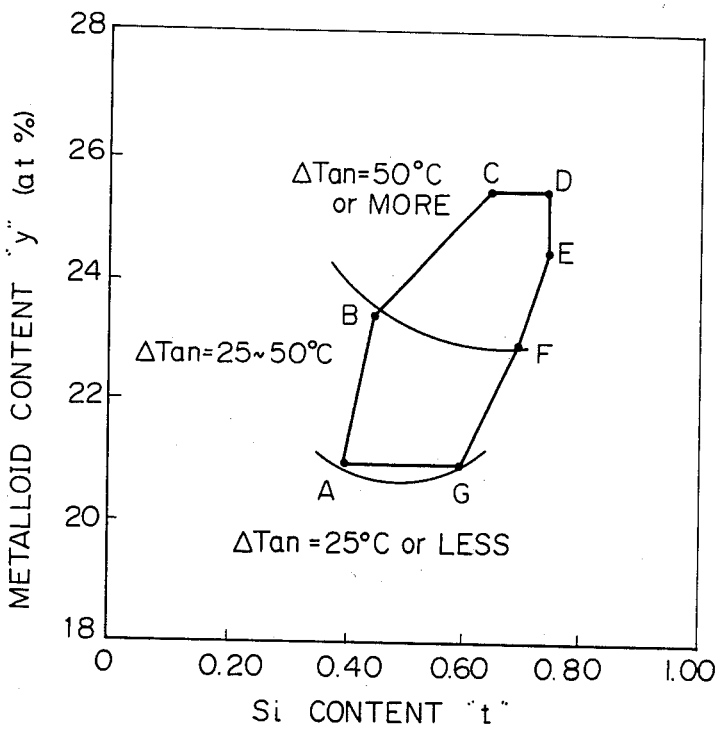
FIG. 11 is a graph of compostional ranges exhibiting ranges of ΔTan, i.e., the difference in the maximum and minimum heat treatment temperatures required for attaining a power loss of 0.15 J or less and a secular change of power loss of 10% or less.

In addition, the difference ΔTan in the maximum and minimum heat treatment temperatures required for attaining a power loss of 0.15 J or less and a secular change in the power loss of less than 10% when each thin strip was heat-treated for 120 minutes was determined. Compositional lines in which the ΔTans are 25° C. and 50° C., respectively, are shown in FIG. 11. It is apparent from the FIG. 11 that the thin strips of the present invention, i.e., those having a composition falling within a region surrounded by A-B-C-D-D-F-G-A or on the A-B-C-D-E-F-G-A line, exhibit a ΔTan of 25° C. or more.

In addition, all the thin strips having a composition falling within a region surrounded by A-B-C-D-E-F-G-A or on the A-B-C-D-E-F-G-A line exhibit excellent corrosion resistance.

EXAMPLE 5

Four thin strips having the thickness is shown in Table 4 were formed from the amorphous magnetic alloy used for forming the thin strips A of Example 2. The strips were subjected to the heat treatment of A-4. Then, the thin strips were formed into cores for a saturable inductor $L_3$ having the same dimension as that described in Example 2. The resultant cores were each wound with two turns of a winding so as to provide saturable inductors $L_3$. The power loss of the inductors was determined in the same manner as that described in Example 2. The results are shown in Table 4.

TABLE 4

| Thickness (μm) | Power loss (J) |
|---|---|
| 60 | 1.15 |
| 40 | 0.58 |
| 15 | 0.09 |
| 12 | 0.06 |

It is apparent from Table 4 that when the thickness of the thin strip exceeds 20 μm, the power loss is increased. Therefore, the thickness of the thin strip should be 20 μm or less, preferably from 5 to 18 μm.

EXAMPLE 6

Thin strips of amorphous magnetic alloys having the compositions indicated in Table 5 were formed. These thin strips were formed into cores in the same manner as that described in Example 2. The characteristics of these cores as the $L_3$, i.e., power loss, ΔBs, relative core volume required for transmitting the same energy, secular change in the power loss, and the difference ΔTan in the maximum and minimum heat treatment temperatures were determined. The results are shown in Table 5.

X-ray diffraction indicated that all the thin strips exhibited a halo pattern and a diffraction peak.

In this example, the corrosion resistance of the thin strips was also tested. The thin strips were held under conditions of a temperature of 55° C. and a relative humidity of 95% for 100 hours. Thereafter, the presence of rust on the strip surface was examined.

The results are shown in Table 5. In Table 5, the symbol Δ indicates that the generation of rust was 10% or less, and the symbol o indicates that no generation of rust was observed.

In addition, in the case of the secular change, the symbol ◎ indicates that no change occurred under the conditions of Example 2.

Also, the difference ΔTan in the maximum and minimum heat treatment temperatures was determined in the same manner as that described in Example 3. The symbol x indicates ΔTan<25° C., the symbol Δ indicates 25° C.≦ΔTan<50° C., and the symbol o indicates 50° C.≧ΔTan.

In addition, the relative core volume is a relative value in this example.

TABLE 5

| Composition (at %) | Power loss (J) | ΔBs (T) | Relative core volume required for transmitting the same energy | Secular change | ΔTan | Corrosion resistance |
|---|---|---|---|---|---|---|
| $Fe_{77}(Si_{0.609}B_{0.391})_{23}$ | 0.08 | 2.9 | 100% | o | o | Δ |
| $Fe_{77}(Si_{0.609}B_{0.304}C_{0.087})_{23}$ | 0.07 | 3.0 | 93 | o | o | Δ |
| $Fe_{77}(Si_{0.609}B_{0.304}P_{0.087})_{23}$ | 0.08 | 2.8 | 107 | ◎ | o | Δ |
| $Fe_{77}(Si_{0.565}B_{0.304}C_{0.087}P_{0.043})_{23}$ | 0.09 | 2.9 | 100 | ◎ | o | Δ |
| $Fe_{77}(Si_{0.478}B_{0.348}C_{0.130}P_{0.043})_{23}$ | 0.10 | 2.9 | 100 | ◎ | o | Δ |
| $Fe_{77}(Si_{0.478}B_{0.261}C_{0.043}P_{0.217})_{23}$ | 0.11 | 2.7 | 115 | ◎ | Δ | Δ |
| $(Fe_{0.897}Co_{0.103})_{78}(Si_{0.5}B_{0.5})_{22}$ | 0.05 | 3.2 | 77 | o | o | Δ |
| $(Fe_{0.795}Ni_{0.205})_{78}(Si_{0.5}B_{0.5})_{22}$ | 0.07 | 2.7 | 109 | o | o | Δ |
| $(Fe_{0.933}Co_{0.04}Ni_{0.027})_{75}(Si_{0.68}B_{0.024}C_{0.04}P_{0.04})_{25}$ | 0.05 | 2.9 | 94 | ◎ | o | Δ |
| $(Fe_{0.974}Mn_{0.026})_{77}(Si_{0.609}B_{0.391})_{23}$ | 0.07 | 2.8 | 105 | ◎ | o | Δ |
| $(Fe_{0.949}Mn_{0.051})_{78}(Si_{0.591}B_{0.273}C_{0.091}P_{0.045})_{22}$ | 0.08 | 2.7 | 112 | ◎ | o | Δ |
| $(Fe_{0.961}Co_{0.026}Mn_{0.013})_{77}(Si_{0.5}B_{0.435}C_{0.043}P_{0.022})_{23}$ | 0.07 | 2.9 | 95 | ◎ | o | Δ |
| $(Fe_{0.949}Cr_{0.051})_{78}(Si_{0.591}B_{0.409})_{22}$ | 0.06 | 2.7 | 111 | ◎ | o | o |
| $(Fe_{0.974}Cr_{0.026})_{78}(Si_{0.727}B_{0.205}C_{0.045}P_{0.023})_{22}$ | 0.10 | 2.8 | 103 | ◎ | o | o |
| $(Fe_{0.974}Mo_{0.026})_{78}(Si_{0.727}B_{0.205}C_{0.045}P_{0.023})_{22}$ | 0.10 | 2.8 | 103 | ◎ | o | o |
| $(Fe_{0.974}W_{0.026})_{78}(Si_{0.727}B_{0.205}C_{0.045}P_{0.023})_{22}$ | 0.11 | 2.9 | 103 | ◎ | o | o |
| $(Fe_{0.974}Cr_{0.019}Mo_{0.006})_{77}(Si_{0.652}B_{0.283}C_{0.043}P_{0.022})_{23}$ | 0.08 | 2.8 | 102 | ◎ | o | o |
| $(Fe_{0.961}Cr_{0.032}Mo_{0.006})_{77}(Si_{0.652}B_{0.283}C_{0.043}P_{0.022})_{23}$ | 0.07 | 2.7 | 108 | ◎ | o | o |
| $(Fe_{0.883}Co_{0.104}Cr_{0.013})_{77}(Si_{0.652}B_{0.283}C_{0.043}P_{0.022})_{23}$ | 0.06 | 3.0 | 88 | ◎ | o | o |
| $(Fe_{0.805}Co_{0.188}Mn_{0.006})_{77}(Si_{0.652}B_{0.283}C_{0.043}P_{0.022})_{23}$ | 0.04 | 3.2 | 77 | ◎ | o | Δ |

While the present invention has been described in reference to specific embodiments, it is not limited there to insofar as the claims do not include such limitation. For example, while a description was given of saturable cores with both the specified amorphous metal compositions and specified coil direction, the inventions covers saturable cores of either the specified amorphous metal composition alone or the specified coil direction alone.

We claim:

1. A saturable core comprising a heat treated coiled thin strip of amorphous magnetic alloy, said heat treated coiled thin strip having a coiling direction identical to a coiling direction thereof during heat treatment thereof, and an electrically insulating film of organic material, having a low heat resistance at a heat treating temperature of said heat treated coiled thin strip in the range from 300°-500° C., interposed between and electrically insulating neighboring coiled layers of said heat treated coiled thin strip.

2. A saturable core according to claim 1, wherein said thin strip has a thickness of 20 μm or less.

3. A saturable core according to claim 1, wherein said thin strip has a thickness of from 5 μm to 18 μm.

4. A saturable core according to claim 1, wherein $\Delta Bs = |-Br| + Bs$ of said saturable core is at least 2.5 Tesla.

5. A saturable core according to claim 1, wherein said thin strip of amorphous magnetic alloy partially contains precipitated fine crystals.

6. A saturable core in accordance with claim 1 wherein said electrically insulating film is at least 100 μm wider than said thin strip at at least one side of said thin strip.

7. A saturable core in accordance with claim 1 wherein said electrically insulating film has a thickness in the range from 0.1-10 μm.

8. A saturable core in accordance with claim 1 wherein said heat treated coiled thin strip has a first end positioned at an inner side thereof and a second end positioned at an outer side thereof, said first and second ends corresponding respectively with inner and outer coiled ends thereof during said heat treatment thereof.

9. A saturable core in accordance with claim 1 wherein said heat treated coiled thin strip has an inner coiled diameter essentially the same as an inner coil diameter thereof during said heat treatment thereof.

10. A saturable core in accordance with claim 1 wherein said heat treated coiled thin strip exhibits an induced one-axis magnetic anisotropy along a longitudinal axis of said strip.

11. A saturable core in accordance with claim 1 wherein said heat treated coiled thin strip exhibits an induced magnetic anisotropy in a longitudinal direction of said strip and parallel to a surface of said strip.

12. A saturable core in accordance with claim 1 wherein said electrically insulating film is a polyimide film.

13. A saturable core in accordance with claim 1 wherein said electrically insulating film is a polyethyleneterephthalate film.

* * * * *